United States Patent [19]

DiBene, II et al.

[11] Patent Number: 5,044,975

[45] Date of Patent: Sep. 3, 1991

[54] CABLE CONNECTOR LOCKING ARRANGEMENT

[75] Inventors: Joseph T. DiBene, II, San Marcos; William F. Roosa, El Cajon; Warren W. Porter, Escondido, all of Calif.

[73] Assignee: NCR Corporation, Dayton, Ohio

[21] Appl. No.: 608,783

[22] Filed: Nov. 5, 1990

[51] Int. Cl.[5] ..... H01R 13/627

[52] U.S. Cl. ..... 439/352; 439/153; 439/357

[58] Field of Search ..... 439/153, 157, 159, 160, 439/352, 353, 355, 357, 358, 545, 549, 607, 609

[56] References Cited

U.S. PATENT DOCUMENTS

| | | | |
|---|---|---|---|
| 3,365,694 | 6/1968 | Parker | 339/17 |
| 3,569,909 | 3/1971 | Garver | 339/91 |
| 3,573,716 | 4/1971 | Garver | 339/128 |
| 3,575,685 | 4/1971 | Gley | 339/45 |
| 3,603,910 | 9/1971 | Schumacher | 339/45 |
| 3,671,921 | 6/1972 | Baker, III et al. | 339/59 |
| 3,842,388 | 10/1974 | Harwood et al. | 339/59 |
| 4,070,081 | 1/1978 | Takahashi | 339/91 |
| 4,214,800 | 7/1980 | Hollyday et al. | 339/45 M |
| 4,299,433 | 11/1981 | Jayne | 339/91 R |
| 4,362,348 | 12/1982 | Stephenson et al. | 339/75 M |
| 4,526,431 | 7/1985 | Kasukawa | 339/45 R |
| 4,533,192 | 8/1985 | Kelley | 339/45 M |
| 4,645,282 | 2/1987 | Frear | 339/45 M |
| 4,828,510 | 5/1989 | Muzslay | 439/352 |
| 4,900,261 | 2/1990 | Gentry et al. | 439/353 |
| 4,941,849 | 7/1990 | Fujiura | 439/357 |

*Primary Examiner*—Paula A. Bradley

*Attorney, Agent, or Firm*—Wilbert Hawk, Jr.; Stephen F. Jewett; Gregory P. Gadson

[57] ABSTRACT

An improved cable connector locking arrangement suitable for D-shell connectors eliminates the standoffs and threaded knobs in standard design and replaces them with tabbed, resilient flanges which snap in place for quick mating and locking of the D-shell connectors. Release bars in the preferred embodiment displace the flanges and hence tabs away from their mating surface for unlocking and disconnection of the connectors.

13 Claims, 6 Drawing Sheets

FIG. 2
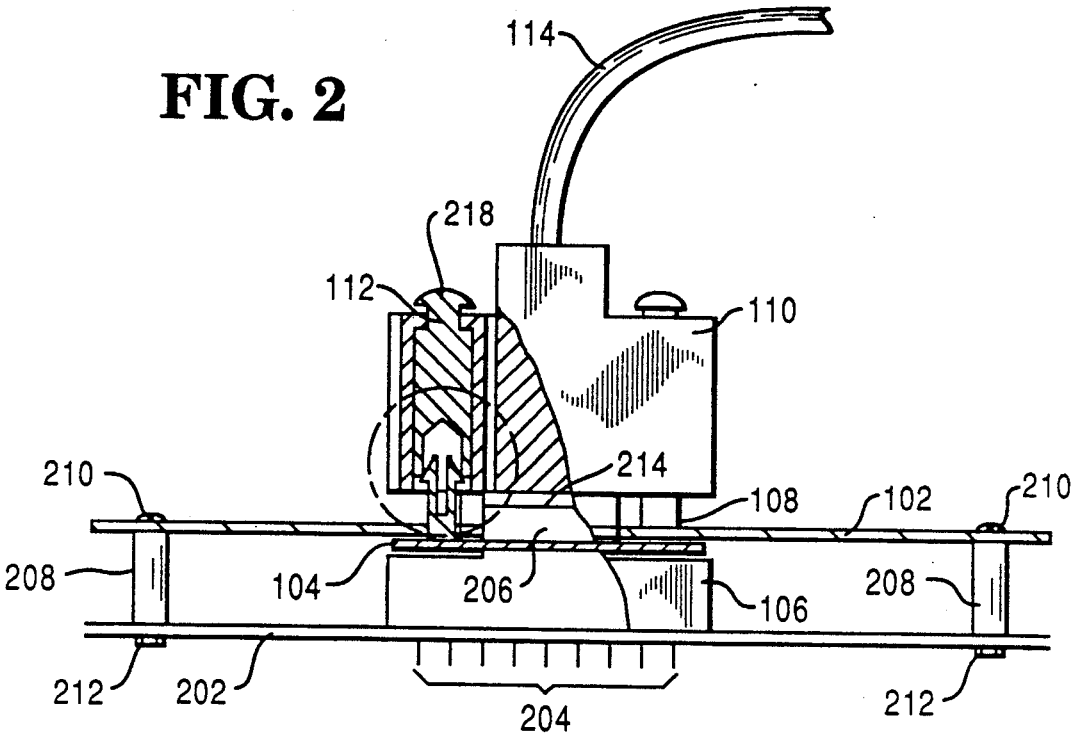
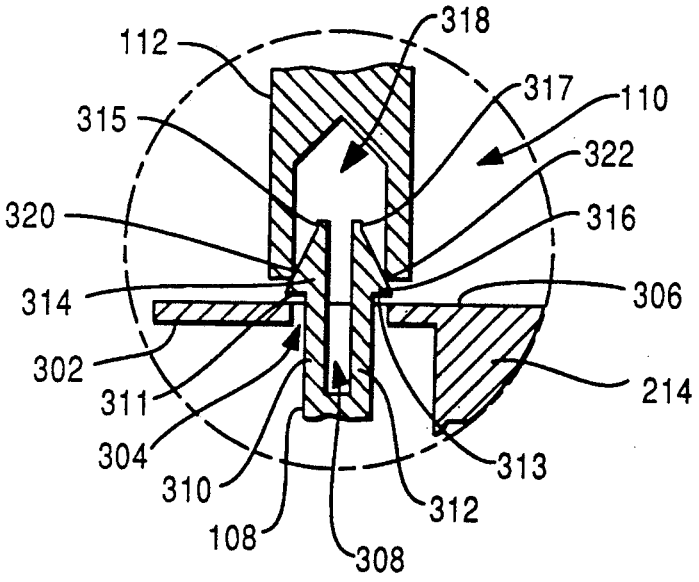
FIG. 3A

CABLE CONNECTOR LOCKING ARRANGEMENT

This invention generally relates to computer cable connectors. More specifically, the present invention relates to an improvement in locking arrangements for D-shell connectors.

BACKGROUND OF THE INVENTION

Prior art external D-shell connectors are mounted to sheet metal covers with two threaded standoffs which are used for both the assembly of the cover and attaching the mating cable. They also use threaded knobs on the cable connector body which are mated with the standoffs. Because of this construction, connection and disconnection are both tedious and time-consuming—especially where a large number of cables is involved.

SUMMARY OF THE INVENTION

To that end, it is an object of the present invention to provide an improved locking arrangement utilizing D-shell connectors in which connection and disconnection can be carried out rapidly.

It is also an object of the present invention to provide an improved locking arrangement which can be locked and unlocked in close proximity to other locking arrangements.

It is an additional object of the present invention to provide an improved locking arrangement which does not require the use of tools for connection and re-connection.

Yet another object of the present invention is provide an improved locking arrangement which meets the above objects, and which also reduces electro-magnetic interference (EMI).

There is provided in accordance with the present invention, a cable connector locking arrangement which at least includes a a first connector, a resilient, cantilever flange, the flange having a tab with an inclined face and a substantially orthogonal catching face, and a second connector connected to a cable and mateable with the first connector, the second connector including a tab receptor cavity with a ledge for each tab on resilient flanges, such that during the mating of the first connector with the second connector, the tab is inserted into the tab receptor cavity, and the inclined face of the tab is impinged upon by the ledge to laterally displace the flange until the catching face reaches the ledge, whereupon the flange springs back to mate the catching face with the ledge, thus locking the first and second connectors in place.

There is further provided, as an alternate embodiment of the present invention, a cable connector locking arrangement which at least includes means for providing a tab receptor cavity with a ledge, a first connector, a second connector connected to a cable and mateable with the first connector, the second connector including a resilient, cantilever flange, the flange having a tab with an inclined face and a substantially orthogonal catching face, and during the mating of the first connector with the second connector, the tab is inserted into the tab receptor cavity, and the inclined face of the tab is impinged upon by the ledge to laterally displace the flange until the catching face reaches the ledge, whereupon the flange springs back to mate the catching face with the ledge, thus locking the first and second connectors in place.

The details of the present invention will be revealed in the following description with reference to the drawings.

BRIEF DESCRIPTION OF THE DRAWINGS

FIG. 2 is a front view with portions removed, of the cable connector locking arrangement of the present invention with the connectors mated and locked.

FIG. 3A is an enlarged view of the release bar and retainer knob of the present invention, as seen in FIG. 2.

DESCRIPTION OF THE PREFERRED EMBODIMENT

Figure 1:
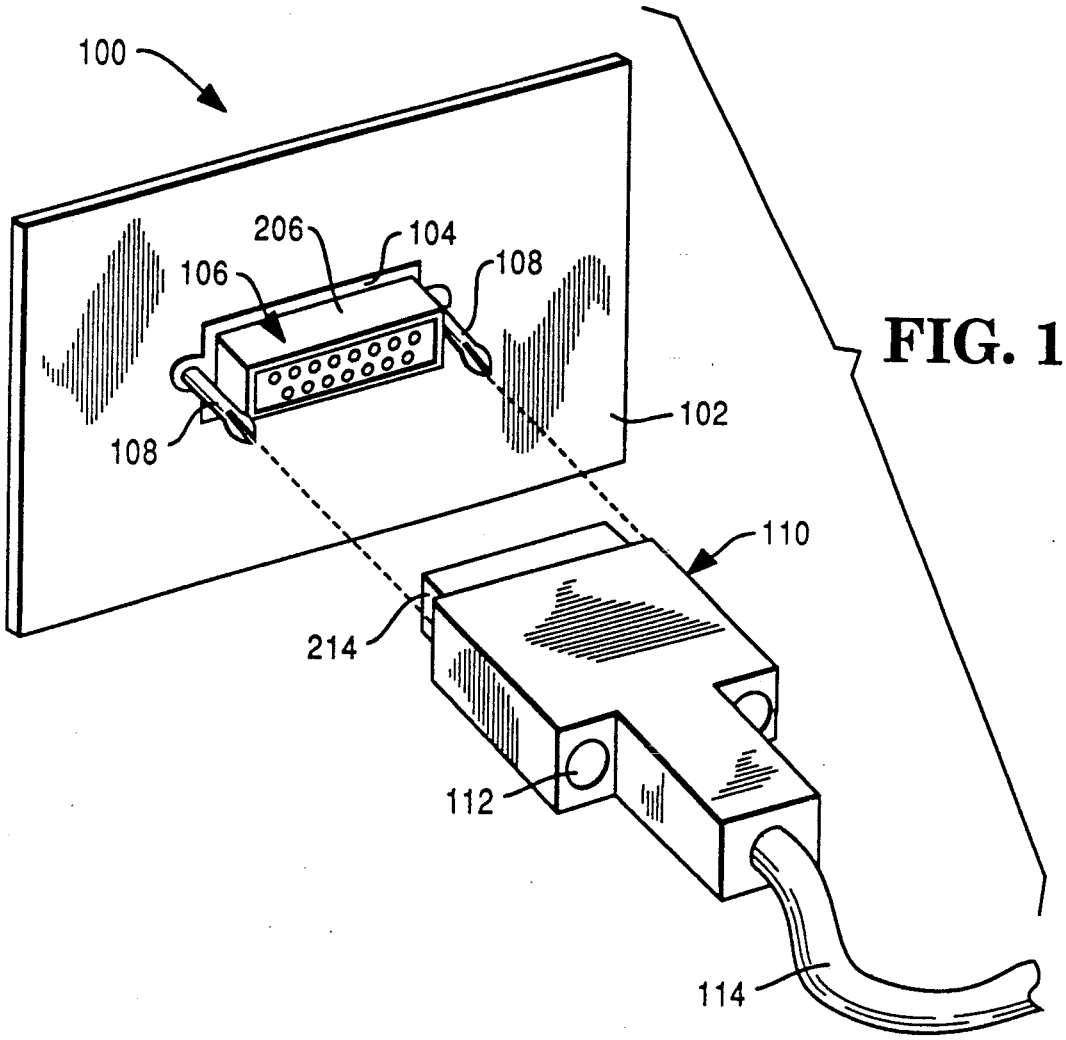
FIG. 1 is an exploded isometric view of the preferred embodiment of the cable connector locking arrangement of the present invention.

The preferred embodiment of the present inventive cable connector locking arrangement is labeled 100 in FIG. 1. A mounting plate 102 covers an EMI spring 104 (best seen in FIGS. 2 and 3), which spring is mounted in between the mounting plate 102 and a female D-shell connector 106. Two retainer knobs 108 (to be explained in greater detail infra) are fastened to the EMI spring 104, and are spaced apart to fit in tab receptor cavities in a male D-shell connector 110 which connects to a cable 114. Once engaged, the two connectors 106 and 110 can be disengaged by pressing release bars 112 to contract tabs on the retainer knobs 108, so that a clearance is created between a ledge in the tab receptor cavities and the tabs, as more fully explained infra.

The side view in FIG. 2 shows the two D-shell connectors 106 and 110 in a locked position. In addition to the components first mentioned in connection with FIG. 1, the following components are also part of the locking arrangement 100. A board 202, which may be either a printed circuit board (PCB) or a backpanel, carries the female connector 106 and electrically connects to the connector 106 via connector wires 204. A portion of a female connector sleeve 206 is seen protruding through the mounting plate 102, which mounting plate 102 is supported by spacers 208 and secured by screws 210 and nuts 212. The mating portion 214 of the male connector 110 is also seen in FIG. 2.

Figure 3:
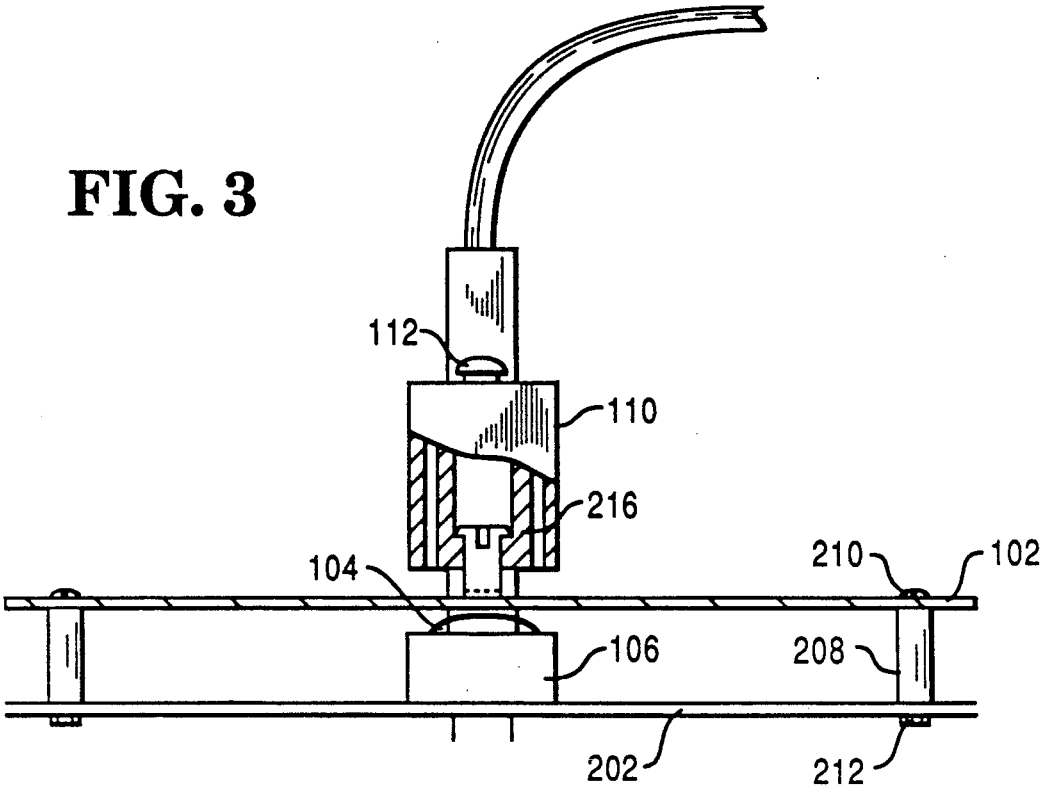
FIG. 3 is a side view with portions removed, of the cable connector locking arrangement of the present invention with the connectors mated and locked.

In FIG. 3, the locking arrangement 100 is shown with the male connector 110 partially removed from the female connector 106. In this position, the EMI spring 104 resumes a natural, curved shape, as shown. When the connectors are locked as shown in FIG. 2, the EMI spring 104 presses firmly against the mounting plate 102 and flattens out for good contact, and hence good EMI shielding. Also shown in FIG. 3 is a guide region 216, which slidably holds the release bar 112, and guides it during translation.

The operation of the release bar and retainer knob will now be described with reference to FIG. 3A. The retainer knob 108 has a hollow 308 which effectively separates it into two resilient flanges or stems 310 and 312 containing tabs 314 and 316 with inclined faces 315 and 317. A tab receptor cavity 304 has an opening which is smaller than the projected area of the tabs 314 and 316 when they are in their natural state. However, the tabs 314 and 316 can be pressed together to form a projected area accommodateable by the opening to the tab receptor cavity 304.

During the connection and locking process, ledges 302 and 306 (forming an outer boundary of the tab receptor cavity 304) impinge upon the inclined faces 315 and 317 of the the tabs 314 and 316, and force the tabs together until they clear the ledges. The flanges (and hence the tabs) snap back to their original spacing, and two catching faces 311 and 313 overlap the ledges 302 and 306 to provide a secure connection. The female and male connector are thus locked in place.

Unlocking the arrangement 100 is accomplished by downwardly pressing the release bar 112. The release bar 112 has a head portion 218 for accommodating a thumb or finger, and hollow 318 with a projected area not larger than the entry to the tab receptor cavity 304. The release bar 112 also contains chamfers 320 and 322 with angles approximately equal to the angles of the inclined faces 315 and 317. During the unlocking process, the chamfers 320 and 322, which follow the downward motion of the release bar 112, contact the inclined faces 315 and 317 and force the tabs toward each other until the catching faces 311 and 313 are free of the ledges 302 and 306. At this point the tabs are clear of the ledges, and the male and female connectors may be pulled apart.

DESCRIPTION OF THE ALTERNATE EMBODIMENTS

Alternate embodiments of the locking arrangement 100 are shown in FIGS. 4 through 9. Rather than dual tabbed retainer knobs, the first alternate embodiment 400 in FIGS. 4 and 5 has retainer knobs (404 and 406) with a single tab on each. It also has inclined face release bars 408 and 410, in which the inclined faces of the release bars (408 and 410) match the inclined faces of the retainer knobs 404 and 406. Otherwise the components and their function are identical to that of the locking arrangement described in FIGS. 1, 2, 3 and 3A.

Figure 5:
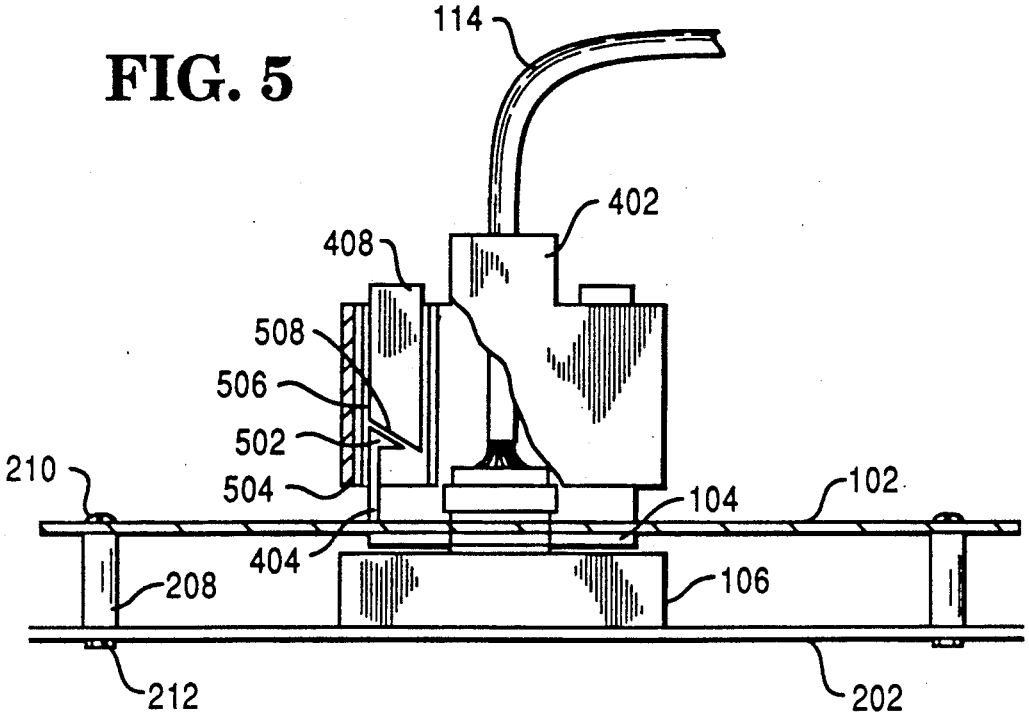
FIG. 5 is a front view with portions removed, of the first alternate embodiment of the present invention with the connectors mated and locked.
Figure 4:
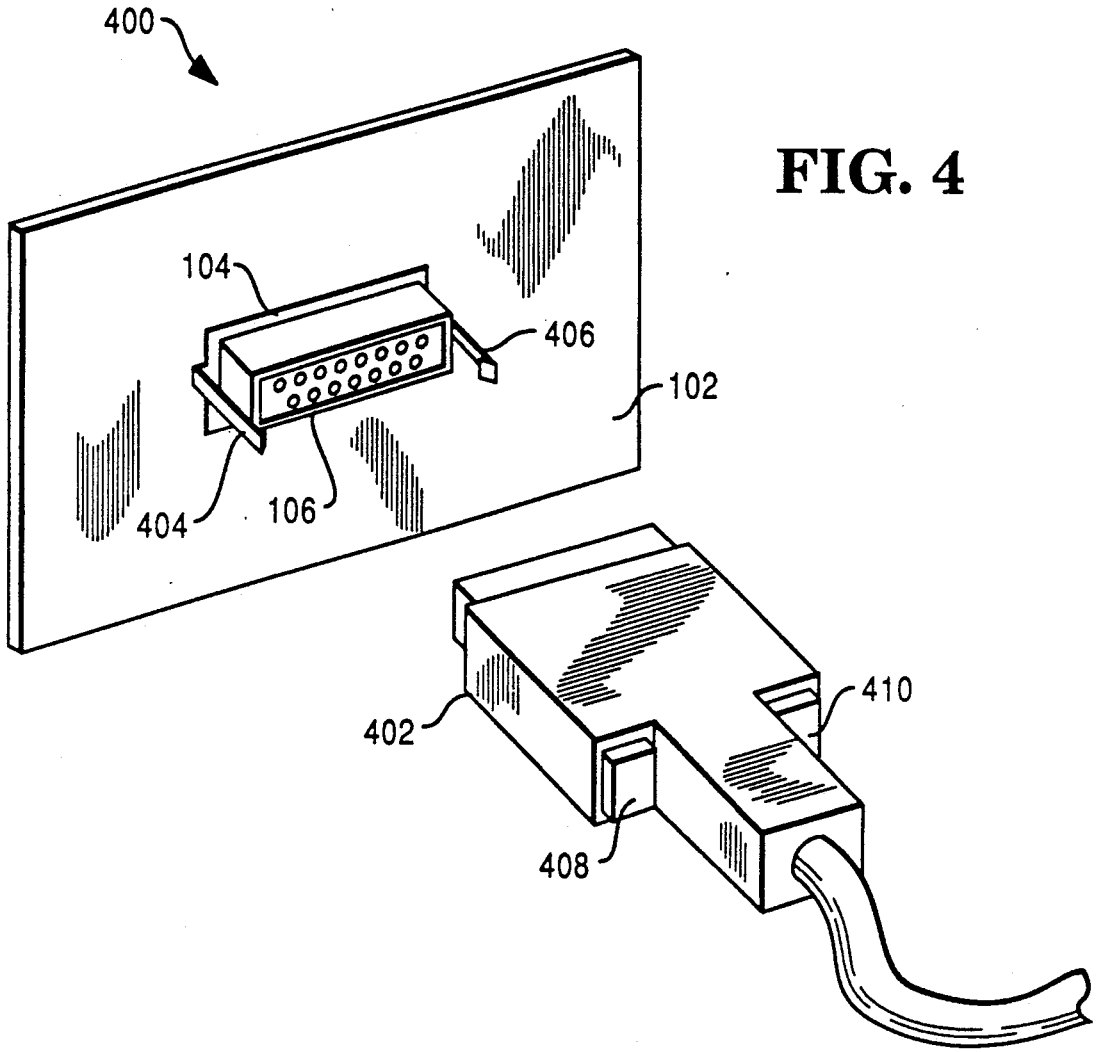
FIG. 4 is an exploded isometric view of a first alternate embodiment of the present invention.
Figure 6:
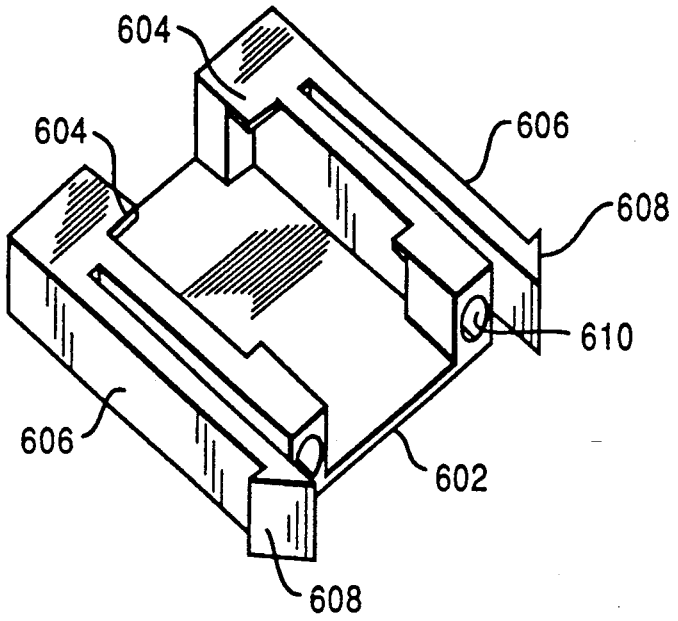
FIG. 6 is an isometric view of a D-shell holding mechanism for a second alternate embodiment of the present invention.

The aforementioned features of the first alternate embodiment are perhaps better seen in FIG. 5, where the number 502 represents the inclined face of the retainer knob 404, 504 represents the outside wall of the male connector 402, 506 represents a guide region (like to the guide region 216 shown in FIG. 3), and 508 represents the inclined face of the release bar 408.

Figure 7:
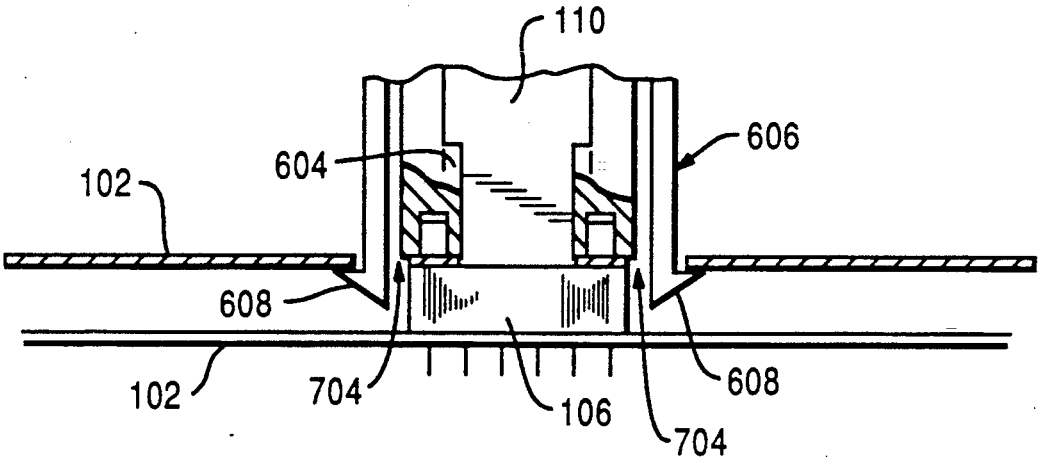
FIG. 7 is a front view with portions removed, of the second alternate embodiment of the present invention with the connectors mated and locked.

The two locking arrangements in FIGS. 6–9 primarily differ from the previously mentioned ones in that the retainer knobs are a part of the male connector, rather than being affixed to the EMI spring. Both alternate embodiments are holding mechanisms which hold and carry a standard male D-shell connector. The holding mechanism 602 in FIGS. 6 and 7 has retaining tabs 604 for retaining an inserted male connector, and clearance holes 610 for clearing standoffs. Two locking tangs 606, having tabs 608, replace the retainer knobs and release bars of the preferred embodiment. Further, notches 704 are required in the plate mounting, as shown in FIG. 7, which take the place of the tab receptor cavities in the preferred embodiment. Insertion or removal is accomplished by squeezing the locking tangs 606 until tabs 608 clear the ledges of the notches 704 in the mounting plate 102, and, in the case of insertion, by pushing the holding mechanism toward the female connector (after which the tangs 606 are released to lock the arrangement), or, in the case of removal, by pulling the holding mechanism away from the female connector.

Figure 8:
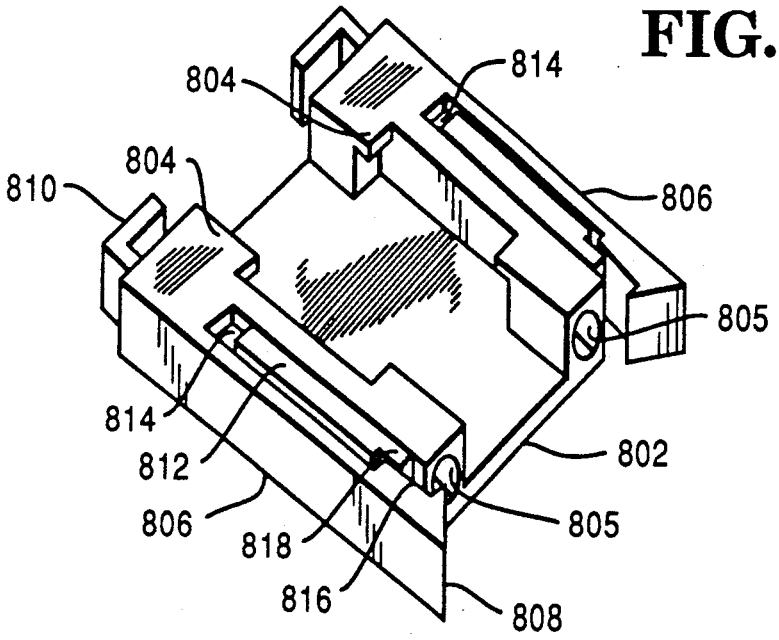
FIG. 8 is an isometric view of a D-shell holding mechanism for a third alternate embodiment of the present invention.
Figure 9:
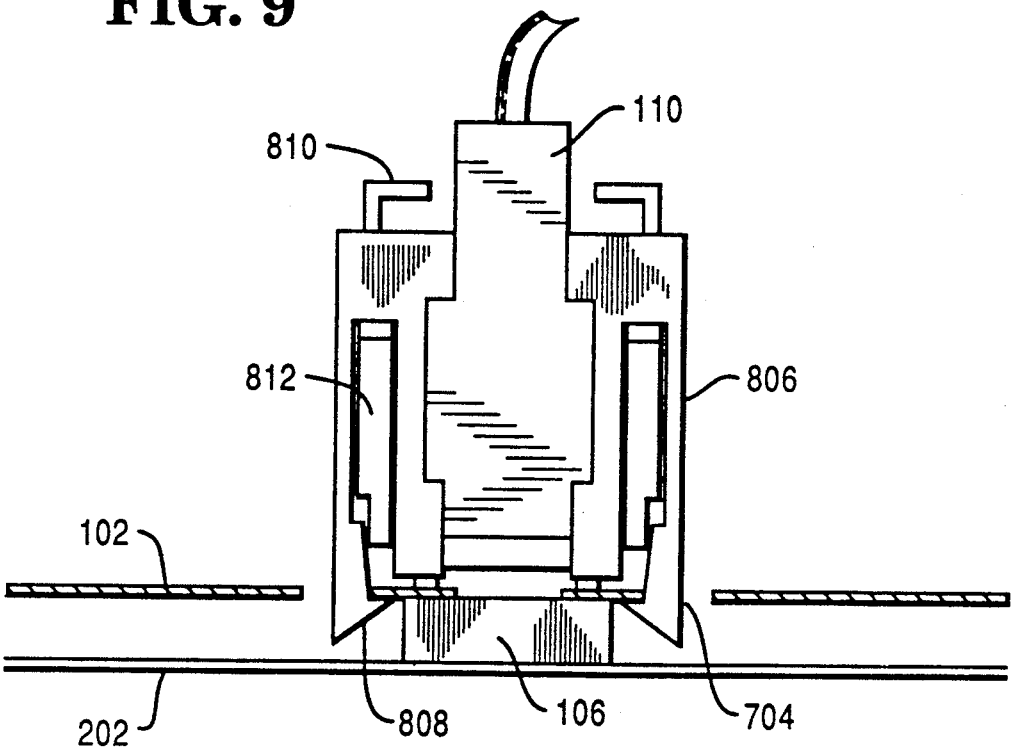
FIG. 9 is a front view of the third alternate embodiment of the present invention with the connectors mated and locked.

In yet a third alternate embodiment shown in FIGS. 8 and 9, a holding mechanism 802 has locking tangs 806 with tabs 808, which must be pried apart rather than squeezed for locking and unlocking. Two retaining tabs 804 and two clearance holes 805 are the same as components 604 and 610 in FIG. 6, respectively. Release bars 810 have portions 812 which slidably fit into guide regions 814. Impacting surfaces 818 of the release bars 810 can be made to impact upon inclined faces 816 of the locking tangs 806 when the release bars 810 are depressed. To lock the arrangement, the holding mechanism 802 is pushed toward the female connector, and the walls of the notches 704 force the locking tangs 806 outward until the tabs 808 lock in place. To unlock the arrangement, the release bars 810 are depressed, thus forcing the locking tangs 806 outward so that the tabs 808 clear the notches 704. The holding mechanism 802 is then pulled away from the female connector 106.

Variations and modifications to the present invention are possible given the above disclosure. However, such variations and modifications are intended to be within the scope of the invention claimed by this letters patent.

We claim:

1. A cable connector locking arrangement comprising:

a first connector:

at least a resilient, cantilever flange, said flange having a tab with an inclined face and a substantially orthogonal catching face; and a second connector coupled to a cable and mateable with said first connector, said second connector comprising a tab receptor cavity with a ledge for each tab on said resilient flange;

during the mating of said first connector with said second connector, said tab is inserted into said tab receptor cavity, and the inclined face of said tab is impinged upon by said ledge to laterally displace said flange until the catching face reaches said ledge, whereupon said flange springs back to mate said catching face with said ledge, thus locking said first and second connectors in place, wherein said second connector further comprises a release bar slidably mounted in said tab receptor cavity, so that during unlocking of said locking arrangement, a first end of said release bar is pressed against the inclined face of said tab to disengage the catching surface from said ledge, and to displace said tab to enable disconnection of said first and second connectors.

2. The cable connector locking arrangement in claim 1 wherein said second connector is also coupled to an EMI shield for EMI reduction in said cable.

3. The cable connector locking arrangement in claim 1 wherein the number of flanges, the number of tab receptor cavities and the number of release bars is two.

4. The cable connector locking arrangement in claim 1 wherein the first end of said release bar has an inclined surface which substantially corresponds to the inclined face of said flange.

5. The cable connector locking arrangement in claim 1 wherein each flange has two tabs.

6. A cable connector locking arrangement comprising:

a first connector:

at least a resilient, cantilever flange, said flange having a tab with an inclined face and a substantially orthogonal catching face; and a second connector coupled to a cable and mateable with said first connector, said second connector comprising a tab receptor cavity with a ledge for each tab on said resilient flange;

during the mating of said first connector with said second connector, said tab is inserted into said tab receptor cavity, and the inclined face of said tab is impinged upon by said ledge to laterally displace said flange until the catching face reaches said ledge, whereupon said flange springs back to mate said catching face with said ledge, thus locking said first and second connectors in place, wherein said second connector is also coupled to an electro-magnetic interference (EMI) shield for EMI reduction is said cable.

7. The cable connector locking arrangement in claim 6 wherein the number of flanges and the number of tab receptor cavities is two, and wherein said second connector further comprises two release bars slidably mounted in said tab receptor cavities.

8. A cable connector locking arrangement comprising:

means for providing at least a tab receptor cavity with a ledge;

a first connector;

a second connector coupled to a cable and mateable with said first connector, said second connector comprising at least a resilient, cantilever flange, said flange having a tab with an inclined face and a substantially orthogonal catching face; and during the mating of said first connector with said second connector, said tab is inserted into said tab receptor cavity, and the inclined face of said tab is impinged upon by said ledge to laterally displace said flange until the catching face reaches said ledge, whereupon said flange springs back to mate said catching face with said ledge, thus locking said first and second connectors in place, wherein said second connector further comprises a release bar slidably mounted in said tab receptor cavity, so that during unlocking of said locking arrangement, a first end of said release bar is pressed against the inclined face of said tab to disengage the catching surface from said ledge, and to displace said tab to enable disconnection of said first and second connectors.

9. The cable connector locking arrangement in claim 8 wherein said second connector is also coupled to an EMI shield for EMI reduction in said cable.

10. The cable connector locking arrangement in claim 8 wherein the number of flanges, the number of tab receptor cavities and the number of release bars is two.

11. The cable connector locking arrangement in claim 8 wherein the first end of said release bar has an inclined surface which substantially corresponds to the inclined face of said flange.

12. The cable connector locking arrangement in claim 8 wherein each flange has two tabs.

13. A cable connector locking arrangement comprising:

means for providing at least a tab receptor cavity with a ledge;

a first connector;

a second connector coupled to a cable and mateable with said first connector, said second connector comprising at least a resilient, cantilever flange, said flange having a tab with an inclined face and a substantially orthogonal catching face; and during the mating of said first connector with said second connector, said tab is inserted into said tab receptor cavity, and the inclined face of said tab is impinged upon by said ledge to laterally displace said flange until the catching face reaches said ledge, whereupon said flange springs back to mate said catching face with said ledge, thus locking said first and second connectors in place, wherein each flange has two tabs.

* * * * *